United States Patent [19]

Kamiwano et al.

[11] Patent Number: 4,729,664

[45] Date of Patent: Mar. 8, 1988

[54] IN-LINE MIXER

[75] Inventors: Mitsuo Kamiwano, Yokohama; Yoshitaka Inoue, Tokyo, both of Japan

[73] Assignee: Inoue Seisakusho (Mfg.) Co., Ltd., Kanagawa, Japan

[21] Appl. No.: 931,240

[22] Filed: Nov. 14, 1986

[30] Foreign Application Priority Data

Nov. 18, 1985 [JP] Japan ..... 60-256547

[51] Int. Cl.[4] ..... B01F 9/00

[52] U.S. Cl. ..... 366/230; 366/220; 366/222; 366/225; 366/336

[58] Field of Search ..... 366/222, 93, 224, 225–229, 366/220, 230, 149, 295, 293, 336–340, 144; 138/37, 40, 44; 137/896

[56] References Cited

U.S. PATENT DOCUMENTS

| | | | |
|---|---|---|---|
| 3,216,345 | 11/1965 | Rigby et al. | 366/224 X |
| 3,912,233 | 10/1975 | Stoeckelmann | 366/222 X |
| 4,113,238 | 9/1978 | Hofmann et al. | 366/224 X |
| 4,330,216 | 5/1982 | Johnson | 366/222 |
| 4,444,509 | 4/1984 | Steiner et al. | 366/224 X |
| 4,474,478 | 10/1984 | De Long | 366/228 X |

FOREIGN PATENT DOCUMENTS

| | | | |
|---|---|---|---|
| 1532560 | 6/1968 | France | 366/222 |
| 921615 | 4/1982 | U.S.S.R. | 366/224 |

*Primary Examiner*—Simone Timothy F.

*Attorney, Agent, or Firm*—Bruce L. Adams; Van C. Wilks

[57] ABSTRACT

An in-line mixer for insertion in a fluid pipeline to mix the fluid flowing through the pipeline comprises a rotary tubular casing composed of magnetic material and rotatably disposed within a housing fitted in the pipeline. A plurality of mixing elements are disposed within the tubular casing and project radially outwardly toward the inner wall of the casing. A set of electromagnetic coils are disposed circumferentially around the outside of the tubular casing and produce a rotating magnetic field to induce rotation of the casing through magnetic coupling of the rotating magnetic field and the magnetic material of the casing. The fluid flowing through the tubular casing is thoroughly stirred and mixed by the combined actions of the mixing elements and the rotating casing, and stagnation of the fluid near the inner wall of the casing is effectively eliminated due to rotation of the casing.

22 Claims, 3 Drawing Figures

IN-LINE MIXER

BACKGROUND OF THE INVENTION (1) Field of the Invention

The present invention relates to in-line mixers of the type which are inserted in a pipeline to stir and mix the material flowing through the pipeline and more particularly, to an in-line mixer having mixing means disposed within a rotationally driven hollow cylinder so that the mixing means mixes and stirs the material as it flows through the inside of the rotating hollow cylinder.

(2) Background Information

There are numerous industrial applications which require the transporting of material through a pipeline from one location to another. It is frequently necessary to effect mixing of the material during its flow through the pipeline, and one means for accomplishing such mixing is to insert a mixer in series along the length of the pipeline. Such mixers are called in-line mixers as they are inserted directly in the pipeline.

One common type of in-line mixer is the so-called static mixer which comprises a housing dimensioned to be fitted in a pipeline and which contains therein a stationary mixing element. The mixing element generally has a plurality of stationary flights for deflecting the flowing material to cause the same to flow radially inwardly and outwardly during its advancement through the housing thereby effecting mixing of the material. In use, the static mixer is inserted in a linear section of a pipeline so that the flowing material enters one end of the housing, undergoes mixing by the stationary mixing element during its advancement through the housing, and exits the other end of the housing into the pipeline.

Under ideal conditions and using an ideal fluid as the flowing material, the static mixer can theoretically attain a uniform radial flow of the fluid together with thorough mixing, good heat conduction and the like. However, in actual practice, ideal conditions do not prevail. Thus, in practice, such a static mixer does not achieve uniform mixing, and stagnation regions form along the pipe wall within the housing. In the case of fluids having low Reynolds numbers, such fluids do not flow easily and considerable stagnation occurs, and such results in inadequate and non-uniform mixing of the fluid.

SUMMARY OF THE INVENTION

One object of the present invention is to provide an in-line mixer for insertion in a pipeline and which effects uniform stirring and mixing of the material flowing through the pipeline.

Another object of the present invention is to provide an in-line mixer for insertion in a pipeline and which promotes the flow of the material in the region near the boundary surfaces to obtain uniform stirring and mixing of the material.

A further object of the present invention is to provide an in-line mixer which is inserted in a pipeline and which effectively stirs and mixes the material without formation of stagnation regions near the boundary surfaces.

A still further object of the present invention is to provide an in-line mixer having a mixing element surrounded by a rotary tubular casing and which, due to the rotation of the tubular casing, the material flowing therethrough is effectively stirred and mixed without stagnating in the region near the tubular casing wall.

Another object of the present invention is to provide an in-line mixer for insertion in a pipeline and which is rugged and durable in construction and compact in size.

These as well as other objects of the invention are carried out by an in-line mixer comprised of a rotary tubular casing rotatably disposed within a housing, mixing means disposed within the tubular casing for mixing and stirring material flowing through the tubular casing, and driving means for rotationally driving the tubular casing, whereby the material is prevented from stagnating adjacent the wall of the tubular casing thereby attaining uniform mixing of the material during its advancement through the in-line mixer.

Other objects and features of the present invention will become apparent to persons of ordinary skill in the art upon a reading of the following description of the invention with reference to the accompanying drawings.

DESCRIPTION OF THE PREFERRED EMBODIMENTS

The in-line mixer of the present invention can employ various kinds of mixing elements, both stationary and movable, and the description of the following embodiments will describe representative kinds of mixing elements. For ease of description, the embodiments will be described with reference to a fluid material, and it is understood that the in-line mixer can be used with virtually all kinds of flowable materials, including liquids, gases, non-Newtonian fluids, such as pseudo-plastic fluid and plastic fluid, slurries, fine particulates and the like.

Figure 1:
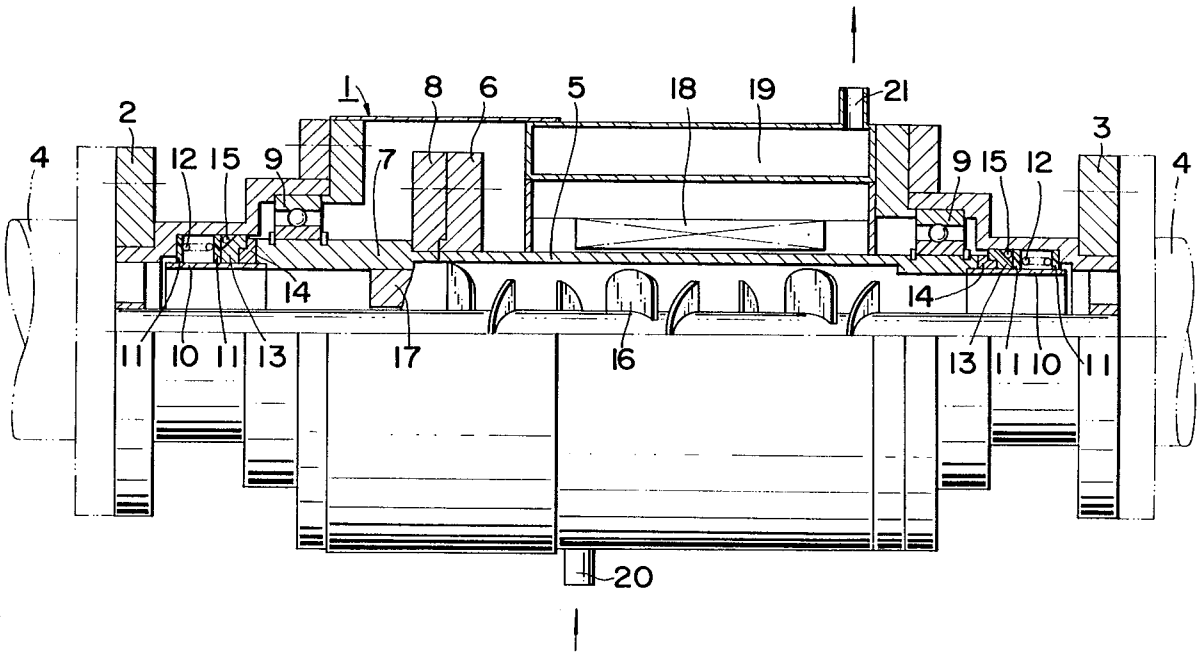
FIG. 1 is a partial sectional front view of one embodiment of an in-line mixer constructed according to the principles of the present invention, the upper half being shown in section.

FIG. 1 shows one embodiment of an in-line mixer comprised of a housing 1 which terminates in a pair of flanges 2,3 for connecting the housing in a section of pipeline 4. A rotary tubular casing 5 is rotatably mounted within the housing 1 by any suitable rotary mounting means. In the disclosed embodiment, the left-hand end of the tubular casing 5 is provided with an annular flange 6 which is fixed to a similar annular flange 8 connected to a cylindrical rotary shaft 7. The shaft 7 is rotatably supported by a ball bearing assembly 9 whose inner race is secured to the shaft 7 and whose outer race is secured to the housing 1. On the end of the rotary shaft 7 is inserted a protecting tube 10. In the annular gap formed between the housing 1 and the protecting tube 10 are disposed a pair of protective Teflon sheets 11 which are biased apart by a spring 12, a pair of seal rings 13 and 14, and an O-ring 15. The seal rings 13,14 and the O-ring 15 provide a fluid-tightseal between the rotary shaft 7 and the inner Teflon sheet 11. The right-hand end of the tubular casing 5 is rotatably mounted in a similar manner and in this case, the end portion of the tubular casing 5 is rotatably mounted directly without use of a rotary shaft 7 and connecting flanges 6,8.

In the present embodiment, the rotary tubular casing 5 has a cylindrical shape. Mixing means 16 is disposed within the tubular casing 5 and in the FIG. 1 embodiment, the mixing means is of the static type, i.e., the mixing means remains stationary. The mixing means 16 comprises a shaft extending lengthwise through the tubular casing 5 and secured at opposite ends to the housing flanges 2,3. A series of mixing elements project radially from the stationary shaft, and the mixing elements are in the form of alternately disposed left-handed and right-handed helical flights. The alternately arranged left-handed and right-handed mixing elements are particularly effective in promoting intermixing of the fluid during its advancement through the tubular casing 5. To assist in the feeding of the fluid, an impeller 17 is secured to the rotary shaft 7 to undergo rotation therewith.

By such a construction, when the in-line mixer is inserted into a pipeline 4 in the manner shown in FIG. 1, a fluid path is formed between the inner wall of the rotary tubular casing 5 and the surface of the stationary shaft of the mixing means 16. The mixing elements 16 and the impeller 17 project radially into the fluid path. Fluid flowing through the pipeline 4 enters an opening at one end of the housing 1 through the flange 2, advances through the fluid path while undergoing mixing (as described in more detail hereinafter), and exits through an opening at the other end of the housing 1 formed in the flange 3 for re-entry into the pipeline 4.

Suitable driving means is provided to rotationally drive the rotary tubular casing 5. Preferably, the driving means is of the electromagnetic type and comprises a set of electromagnetic coils 18 disposed around and spaced from the outer periphery of the tubular casing 5 for generating a rotating magnetic field. Conventional drive circuitry (not shown) is connected to the electromagnetic coils 18 for suitably energizing the coils to produce the rotating magnetic field. In order to induce rotation of the tubular casing 5 by the rotating magnetic field, the casing 5 is composed of magnetic material, such as iron, silicon steel and the like. It is not necessary to form the entire tubular casing of such magnetic material and, if desired, only that portion of the casing which opposes the electromagnetic coils 18 need be formed of magnetic material. Alternatively, a member composed of magnetic material may be secured to the outside of the tubular casing 5 instead of forming the casing of magnetic material. By such a construction, the rotating magnetic field produced by the electromagnetic coils 18 induces rotation of the tubular casing 5 in the same direction as the direction of rotation of the rotating magnetic field. Alternatively, the magnetic material, whether it be part of the tubular casing 5 or a separate attached member, may be configured to define pole pieces circumferentially spaced apart around the tubular casing 5 at a suitable angular spacing relative to that of the electromagnetic coils 18 so that the rotating magnetic field generated by the electromagnetic coils coacts with the pole pieces to induce rotation of the tubular casing 5. The driving means thus operates according to the same principles as an induction motor.

Cooling means is provided to dissipate the heat generated as a result of the energization of the electromagnetic coils 18. The cooling means comprises a cooling jacket 19 surrounding the electromagnetic coils 18, and the cooling jacket 19 is provided with an inlet 20 and an outlet 21 for circulating a cooling medium, such as water, through the cooling jacket 19. The cooling means thus circulates the cooling medium in indirect heat-exchange relation with the electromagnetic coils 18, and the heat generated by energization of the coils is absorbed by the cooling medium during its circulation through the cooling jacket 19.

In operation, and assuming that the in-line mixer is connected in a pipeline 4 as shown in FIG. 1, the fluid flowing through the pipeline enters one end of the housing 1 through the opening formed in the flange 2. Upon energization of the electromagnetic coils of the electromagnetic driving means, a rotating magnetic field is produced to induce rotation of the tubular casing 5. The rotary shaft 7, which is fixedly secured to the tubular casing 5, is also rotationally driven. As the rotary shaft 7 rotates, the impeller 17 is rotationally driven to impart a pumping action to the fluid thereby assisting the feeding of the fluid axially through the fluid path defined between the inside wall of the tubular casing 5 and the shaft surface of the mixing means 16. During its flow along the fluid path, the fluid is repeatedly deflected by the left-handed and right-handed mixing elements which force the fluid to flow radially outwardly toward the inner wall of the tubular casing 5. At the same time, in view of the rotation of the tubular casing 5, the fluid is not permitted to stagnate along the inner wall of the inner casing 5 but rather the rotary motion of the casing causes the fluid to flow radially inwardly back towards the mixing elements. In this manner, the fluid flows radially inwardly and outwardly during its advancement through the rotating tubular casing 5, and the fluid is thoroughly mixed and stirred due to the turbulence created by the coaction of the mixing elements and the rotating tubular casing. Due to the rotation of the tubular casing 5, the stirring effect is considerably greater than that which would be obtained if the tubular casing were not rotated, and the formation of stagnation regions along the inner surface of the tubular casing is prevented.

Figure 2:
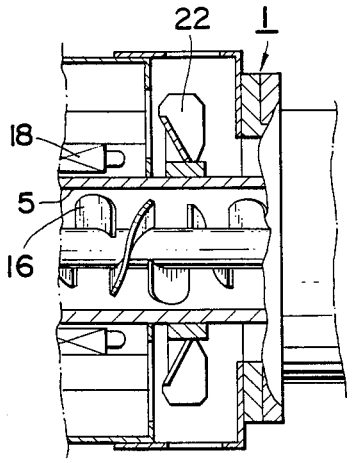
FIG. 2 is a partial sectional front view showing another embodiment of a cooling device used with the in-line mixer.

FIG. 2 shows a modified form of the in-line mixer shown in FIG. 1, and in this embodiment air cooling rather than water cooling is used to dissipate the heat produced by the electromagnetic coils 18. The cooling means shown in FIG. 2 comprises a cooling fan 22 secured to the rotary tubular casing 5 for rotation therewith. The cooling fan 22 is encased within a casing having openings for admitting air. In operation, the cooling fan 22 is rotationally driven by the rotating tubular casing 5, and air is withdrawn from the exterior and circulated over the electromagnetic coils 18 to cool the same. In this embodiment, the cooling medium flows in direct heat-exchange relation with the electromagnetic coils 18.

Figure 3:
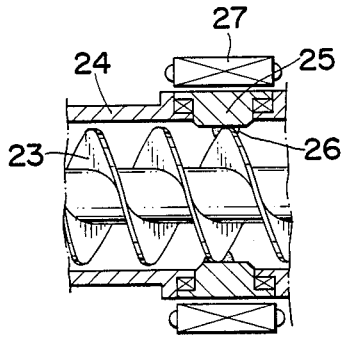
FIG. 3 is a partial sectional front view showing another embodiment of an in-line mixer constructed according to the principles of the present invention.

Another embodiment of an in-line mixer according to the principles of the present invention is shown in FIG. 3. In this embodiment, a rotating mixing element is used. As shown, a helical screw 23 having a helical mixing flight is rotatably mounted within a stationary tube 24 which extends lengthwise through the housing (not shown). In this embodiment, the rotary tubular casing is in the form of a rotary cylinder 25 mounted through bearings (not numbered) to undergo rotation relative to the stationary tube 24. The inner side of the rotary cylinder 25 is connected by welds 26 to the flight of the helical screw 23 so that rotation of the rotary cylinder 25 will effect corresponding rotation of the helical screw 23. Electromagnetic driving means comprises a set of electromagnetic coils 27 disposed around the circumference of the rotary cylinder 25 for generating a rotating magnetic field to induce rotation of the rotary cylinder 25 accompanied by rotation of the helical screw 23. By such a construction, the fluid flowing through the stationary tube 24 is effectively mixed and stirred by the rotating helical mixing screw 23, and the fluid is efficiently transported through the in-line mixer without formation of stagnation regions.

As described above, the in-line mixer according to the present invention is simple in construction, compact in size, and achieves a thorough and uniform mixing of the fluid. Also, by providing an impeller at the upstream end of the rotary tubular casing, the pump which is usually employed in in-line mixers can be eliminated.

What is claimed is:

1. An in-line mixer for insertion in a pipeline to effect mixing of material flowing through the pipeline, the in-line mixer comprising: a housing having a pair of openings at opposite ends thereof and insertable in a pipeline during use of the in-line mixer so that the material flowing through the pipeline enters one opening and exits the other opening; a rotary tubular casing rotatably disposed within the housing, the tubular casing having opposite ends communicating with the housing openings so that the material which enters the one housing opening flows through the inside of the tubular casing and exits the other housing opening; mixing means disposed within the tubular casing and coacting therewith during rotation of the tubular casing to effect mixing and stirring of the material accompanied by advancement of the material through the tubular casing; and electromagnetic driving means for electromagnetically rotationally driving the tubular casing, the electromagnetic driving means comprising at least a part of the tubular casing being composed of magnetic material, and electromagnetic means disposed around and spaced from the outside of the tubular casing adjacent the magnetic material for electromagnetically generating a rotating magnetic field of sufficient strength to induce rotation of the tubular casing through the magnetic coupling of the rotating magnetic field with the magnetic material of the tubular casing.

2. An in-line mixer according to claim 1; wherein the electromagnetic means for electromagnetically generating a rotating magnetic field comprises a set of electromagnetic coils operative when electrically energized to produce the rotating magnetic field.

3. An in-line mixer according to claim 1; including means fixedly mounting the mixing means so that the mixing means remains stationary within the tubular casing.

4. An in-line mixer according to claim 1; including cooling means for cooling the electromagnetic means to dissipate the heat produced by the electromagnetic means during generation of the rotating magnetic field.

5. An in-line mixer according to claim 4; wherein the cooling means comprises means for flowing a cooling medium in indirect heat-exchange relationship with the electromagnetic means.

6. An in-line mixer according to claim 4; wherein the cooling means comprises means for flowing a cooling medium in direct heat-exchange relationship with the electromagnetic means.

7. An in-line mixer according to claim 1; including an impeller connected to undergo rotation with the tubular casing for assisting in advancing the flow of material through the tubular casing.

8. An in-line mixer according to claim 4; wherein the mixing means comprises a plurality of left-handed and right-handed mixing elements alternately connected along the length of a shaft disposed lengthwise in the tubular casing.

9. An in-line mixer according to claim 1; wherein the mixing means comprises a helical screw.

10. An in-line mixer for insertion in a pipeline to effect mixing of material flowing through the pipeline, the in-line mixer comprising: a housing having a pair of openings at opposite ends thereof and insertable in a pipeline during use of the in-line mixer so that the material flowing through the pipeline enters one opening and exits the other opening; a rotary tubular casing rotatably disposed within the housing, the tublar casing having opposite ends communicating with the housing openings so that the material which enters the one housing opening flows through the inside of the tubular casing and exits the other housing opening; mixing means disposed within the tubular casing and coacting therewith during rotation of the tubular casing to effect mixing and stirring of the material accompanied by advancement of the material through the tubular casing; and electromagnetic driving means for electromagnetically rotationally driving the tubular casing, the electromagnetic driving means comprising a magnetic member composed of magnetic material affixed to the outside of the tubular casing, and electromagnetic means disposed around and spaced from the magnetic member for electromagnetically generating a rotating magnetic field of sufficient strength to induce rotation of the tubular casing through the magnetic coupling of the rotating magnetic field with the magnetic member.

11. An in-line mixer according to claim 10; wherein the electromagnetic means for electromagnetically generating a rotating magnetic field comprises a set of electromagnetic coils operative when electrically energized to produce the rotating magnetic field.

12. An in-line mixer according to claim 10; including means fixedly mounting the mixing means so that the mixing means remains stationary within the tubular casing.

13. An in-line mixer according to claim 10; including cooling means for cooling the electromagnetic means to dissipate the heat produced by the electromagnetic means during generation of the rotating magnetic field.

14. An in-line mixer according to claim 13; wherein the cooling means comprises means for flowing a cooling medium in indirect heat-exchange relationship with the electromagnetic means.

15. An in-line mixer according to claim 13; wherein the cooling means comprises means for flowing a cooling medium in direct heat-exchange relationship with the electromagnetic means.

16. An in-line mixer according to claim 10; including an impeller connected to undergo rotation with the tubular casing for assisting in advancing the flow of material through the tubular casing.

17. An in-line mixer according to claim 10; wherein the mixing means comprises a plurality of left-handed and right-handed mixing elements alternately connected along the length of a shaft disposed lengthwise in the tubular casing.

18. An in-line mixer according to claim 10, wherein the mixing means comprises a helical screw.

19. An in-line mixer for insertion in a pipeline to effect mixing of material flowing through the pipeline, the in-line mixer comprising: a housing having a pair of openings at opposite ends thereof and insertable in a pipeline during use of the in-line mixer so that the material flowing through the pipeline enters one opening and exits the other opening; a stationary tubular casing fixedly disposed within the housing, the tubular casing having opposite ends communicating with the housing openings so that the material which enters the one housing opening flows through the inside of the tubular casing and exits the other housing opening; rotary mixing means rotatably disposed within and extending lengthwise along the tubular casing and coacting therewith during rotation of the mixing means to effect mixing and stirring of the material accompanied by advancement of the material through the tubular casing; and electomagnetic driving means for electromagnetically rotationally driving the mixing means, the electromagnetic driving means comprising a rotary hollow cylinder rotatably mounted on the stationary tubular casing and connected to the mixing means to effect rotation thereof in response to rotation of the hollow cylinder, at least a part of the hollow cylinder being composed of magnetic material, and electromagnetic means disposed around and spaced from the outside of the hollow cylinder adjacent the magnetic material for electromagnetically generating a rotation magnetic field of sufficient strength to induce rotation of the hollow cylinder through the magnetic coupling of the rotating magnetic field with the magnetic material of the hollow cylinder to thereby rotationally drive the mixing means.

20. An in-line mixer according to claim 19; wherein the electromagnetic means for electromagnetically generating a rotating magnetic field comprises a set of electromagnetic coils operative when electrically energized to produce the rotating magnetic field.

21. An in-line mixer according to claim 19; wherein the mixing means comprises a helical screw having a helical mixing flight connected to the hollow cylinder.

22. An in-line mixer according to claim 19; including cooling means for cooling the electromagnetic means to dissipate the heat produced by the electromagnetic means during generation of the rotating magnetic field.

* * * * *